US009993696B2

(12) United States Patent
Hogan

(10) Patent No.: US 9,993,696 B2
(45) Date of Patent: Jun. 12, 2018

(54) GOLF BALL DISPENSER

(71) Applicant: Kevin Dale Hogan, Pensacola, FL (US)

(72) Inventor: Kevin Dale Hogan, Pensacola, FL (US)

( * ) Notice: Subject to any disclaimer, the term of this patent is extended or adjusted under 35 U.S.C. 154(b) by 0 days. days.

(21) Appl. No.: 15/637,560

(22) Filed: Jun. 29, 2017

(65) Prior Publication Data

US 2018/0001155 A1 Jan. 4, 2018

Related U.S. Application Data

(60) Provisional application No. 62/356,931, filed on Jun. 30, 2016.

(51) Int. Cl.

| | |
|---|---|
| ***A47F 1/08*** | (2006.01) |
| ***A63B 47/00*** | (2006.01) |
| ***A63B 55/20*** | (2015.01) |

(52) U.S. Cl.

CPC ..... *A63B 47/002* (2013.01); *A63B 55/20* (2015.10); *A47F 1/08* (2013.01)

(58) Field of Classification Search

CPC ..... A63B 55/20

USPC ..... 221/64, 185, 307, 309, 260, 279; 206/315.9; 224/918, 919

See application file for complete search history.

(56) References Cited

U.S. PATENT DOCUMENTS

| | | | | |
|---|---|---|---|---|
| 3,497,118 | A * | 2/1970 | Najjar | A63B 47/00 211/14 |
| 4,850,483 | A * | 7/1989 | Stack | A63B 55/20 206/315.9 |
| 5,474,191 | A | 12/1995 | Bergeron et al. | |
| 5,673,812 | A * | 10/1997 | Nelson | A63B 47/002 221/265 |
| 2008/0099503 | A1* | 5/2008 | Altieri | F42B 39/002 221/156 |
| 2011/0108566 | A1* | 5/2011 | Read | A63B 47/002 221/260 |

* cited by examiner

*Primary Examiner* — Timothy R Waggoner
*Assistant Examiner* — Ayodeji T Ojofeitimi
(74) *Attorney, Agent, or Firm* — Erise IP, P.A.

(57) ABSTRACT

A system and method for dispensing golf balls is disclosed. Balls are received into a cylindrical tube, and are supported on a shelf that extends inwardly at a dimension that retains the balls when they are stacked vertically. Balls are removed through a forward opening.

5 Claims, 6 Drawing Sheets

GOLF BALL DISPENSER

CROSS-REFERENCE TO RELATED APPLICATIONS

This application claims priority to U.S. Provisional Patent Application 62/356,931, filed Jun. 30, 2016. The disclosure of which is incorporated herein by reference.

BACKGROUND OF THE INVENTION

1. Field

The disclosed embodiments relate generally to the field of golf equipment. More specifically, the embodiments relate to the field of containing an then allowing access to golf balls during a round of golf.

2. Description of the Related Art

Conventionally, golfers carry golf balls in a pouch provided in a golf bag. Some players unzip the pouch to take the balls out for play. Some golfers also carry additional balls clipped in a small ball holder in the golf cart itself. Most golfers in preparation of play will empty their pockets of wallets, take off rings from their fingers and remove watches from their wrists to help reduce restrictions that may affect their golf club grip and their swing. A very common place to store a couple extra golf balls is the front pocket of the shorts or pants the golfer is wearing, thereby potentially replacing the vary restrictions he or she may have just removed by emptying their pockets in the first place.

Another conventional system uses a mechanical holding device, where the ball was pressed between two opposing loops of wire that would hold the ball in a pinching kind of method. After continual use, the two wire loops tend to lose tension, requiring the user to forcibly pinch the two loops closer together to help increase the tension to hold the ball. See, e.g., U.S. Pat. No. 5,474,191. Over pinching the two loops in this sort of system makes the removing and replacing of balls increasingly more difficult.

Another conventional system is a bag hooked to the outside of the golf bag that holds a few balls. Players using this system have to untie the tie securing the balls in the bag and then retie the string to keep the balls from working out.

SUMMARY

A ball dispenser apparatus is disclosed that has a cylindrical body. The body has a ball-receiving opening at a top portion, and an internal diameter sized to allow the passage of a golf ball. A member extends inwardly at a bottom of the cylindrical body, this inwardly-extending member creating an internal dimension in the body. The internal dimension is sized to restrict the ball from falling out, and rest in a position at the bottom of the cylindrical body. A retrieval opening in a lower portion of the cylindrical body, the opening being sized to allow for ball retrieval.

In embodiments, the device has a hinged lid for the ball-receiving opening, the lid being openable for the loading of golf balls, or latchable to contain balls within the cylindrical body. In other embodiments, a clip on the back of the cylindrical body allows for installing the dispenser on a golf bag.

The cylindrical body can be opaque, translucent, or transparent.

In embodiments, the member extending inwardly at a bottom of the cylindrical body is an internally extending shelf which is coaxial with the cylindrical body for a substantial portion of the circular cross section of the cylindrical body. The shelf, in some embodiments, extends coaxially inwardly from a substantial portion of the cylindrical body, and then extends upward to create a ball-supporting ridge. In some embodiments, the shelf and a pair of coaxial opposed termination points of the shelf create openness from below and in front enabling a user to lift a finger up through a crescent-shaped aperture and retrieve a ball through the retrieval opening.

BRIEF DESCRIPTION OF THE SEVERAL VIEWS OF THE DRAWINGS

Illustrative embodiments are described in detail below with reference to the attached drawing figures, which are incorporated by reference herein and wherein.

DETAILED DESCRIPTION

Embodiments provide systems and a method for containing and dispensing golf balls. The disclosed device places the additional balls within easy access of the golfer. The balls can be accessed without bending over or wasting time unzipping, or otherwise opening some sort of pouch or other arrangement.

This has been accomplished in the device shown in FIGS. 1-6. The dispenser is cylindrical in shape and is configured to be temporarily mounted on a golf bag on a vertical axis by means of a clip. The cylindrical housing is of sufficient inner diameter to allow a golf ball to freely move up and down the vertical axis inside the "tube". The bottom of the tube is partially enclosed, preventing the balls from falling out the bottom.

On the front of the disclosed device opposite the back and at a position near the bottom of the tube, there is a hole of proper diameter to allow a ball to exit the tube horizontally when lifted up from below with a finger. The player's finger is allowed up through a crescent-shaped aperture made into the bottom of the dispenser for ball dislodging the lowest ball in the tube to be extracted.

At the top of the device there is a lid that pivots open to allow the tube to be loaded with balls and then securely locks closed to prevent balls from rolling out should the device be placed in a horizontal position. The vertical length of the device varies, depending on the application that it is designed to fulfill.

In embodiments, the dispenser is constructed of plastic, although it is possible that numerous other materials could be used to construct all or parts of the device and still fall within what is disclosed herein.

The top of the lid is flat, allowing for the inclusion of indicia, e.g., custom logos, etc., to be printed on them for special occasions and custom company gifts and personalization. In some embodiments, the dispenser is solid. In other versions the device is formed of transparent or translucent material to provide easy viewing of the number of balls remaining in the device.

Figure 1:
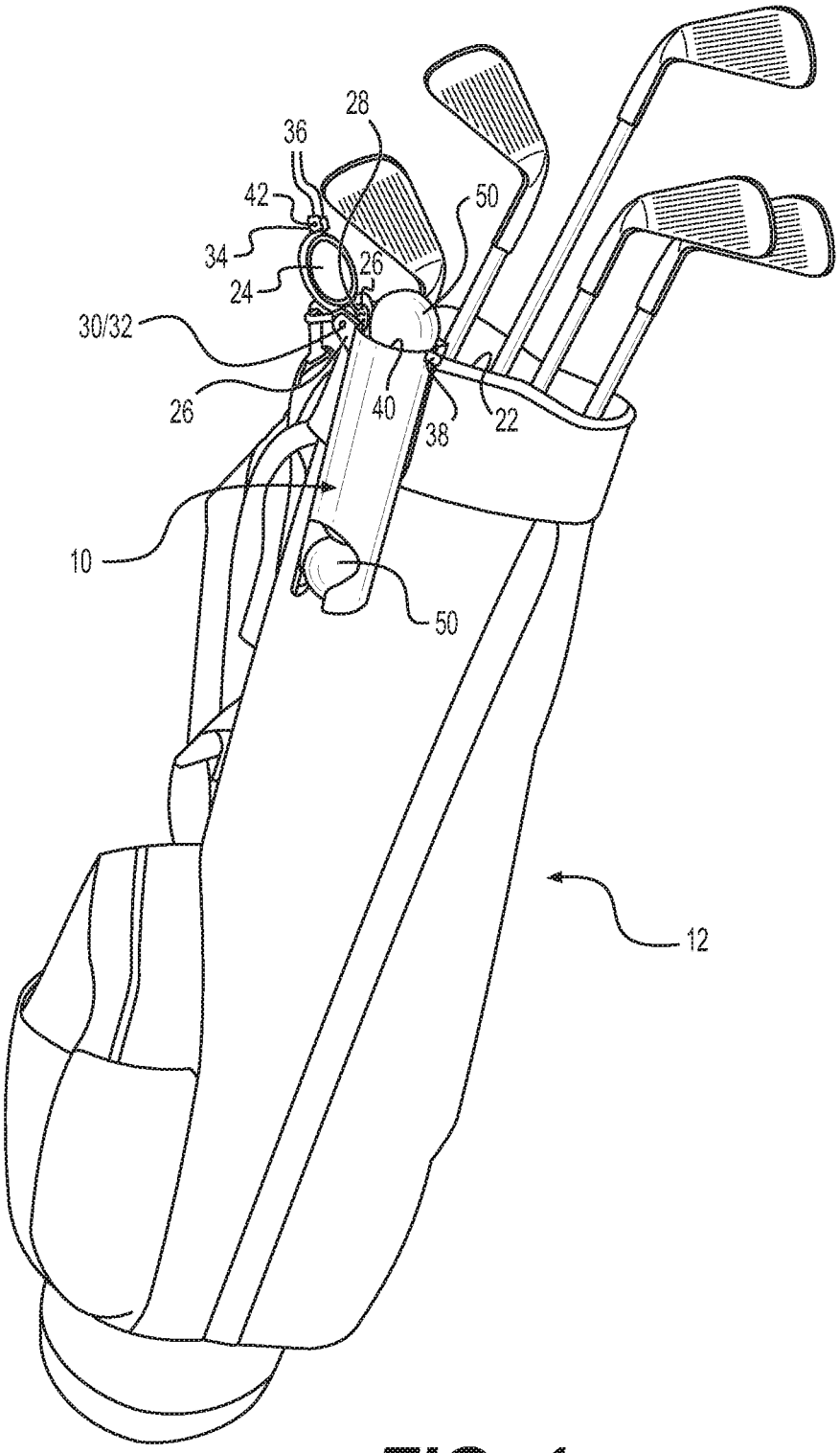
FIG. 1 is a perspective view showing the dispenser installed on a golf bag where the lid is open.
Figure 2:
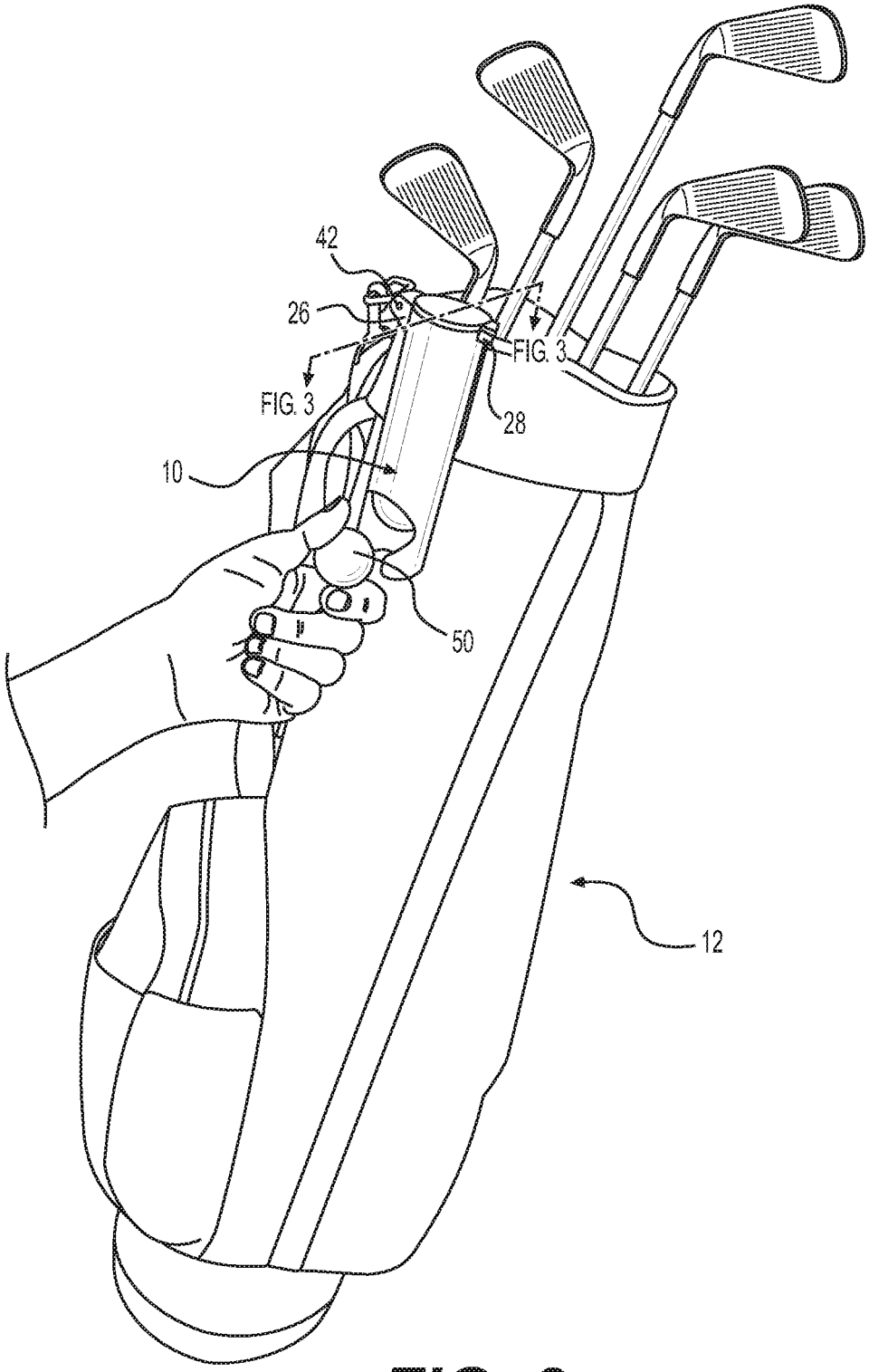
FIG. 2 is a perspective view showing the dispenser on a bag where the lid is closed, and a ball has been retracted.

Referring to FIG. 1, a ball dispenser 10 is configured to be mountable onto a golf bag 12. Mounting is made possible using a clip 14 located at the upper portion of the dispenser 10. The clip 14 has a portion 16 which extends outwardly, and then a portion 18 that extends downwardly. Thus, a receiving space 20 is defined into which an upper portion 22 of the bag 12 is received.

A lid 24 at the top of the dispenser 10 is pivotally mounted, and includes a top surface 27 which is flat in order to receive indicia, e.g., a logo or other information. The details regarding the lid can be seen in detail in FIGS. 5-6. The pivotal mount 23 comprises two laterally extending parallel and opposed walls 26, between which an outwardly extending portion 28 of the lid 24 is rotated. The outwardly extending portion 28 of the lid has two outwardly extending axle portions 30 on opposite sides of the outwardly extending portion 28 which are received into apertures 32 formed into each of the walls 26. An opening 41 is created in the substantially cylindrical body 46 below the outwardly extending portion 28 to allow for clearance upon the rotation.

On the other side of the lid 24, an outwardly extending portion 34 includes to downwardly extending members 36. Downwardly extending members 36 are configured to clamp inwardly on an outwardly extending tang 38 which extends out from an upper rim 40 of the dispenser 10. Apertures 42 are formed in each of the downwardly extending members 36 which receive subtle outwardly extending protrusions 44 may on the outer surfaces of the tang 38. Thus, the lid 24 is able to be snapped into place.

Figure 3:
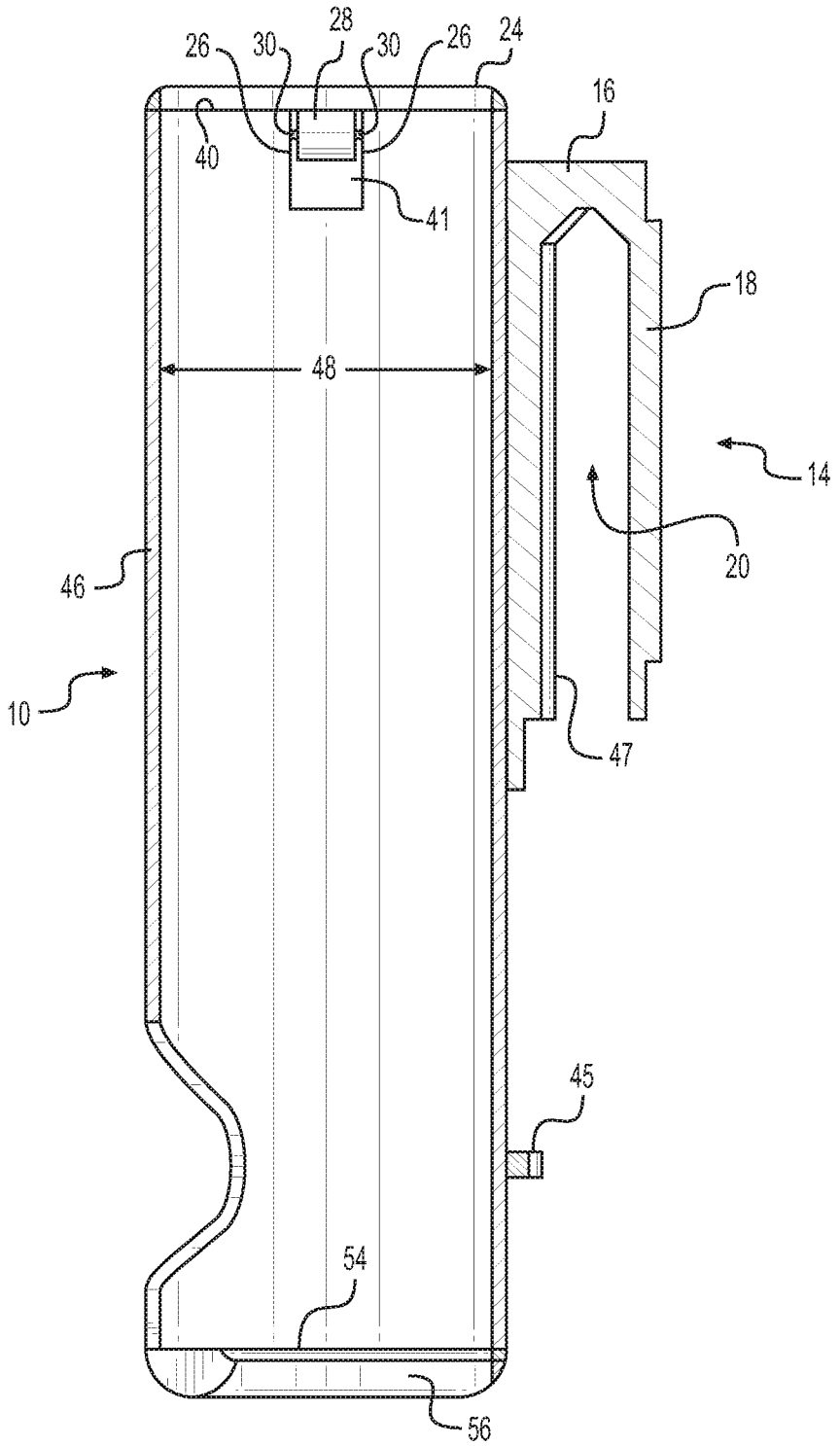
FIG. 3 is a cross-sectional drawing taken at the section shown in FIG. 2 splitting down the middle of the dispenser.
Figure 4:
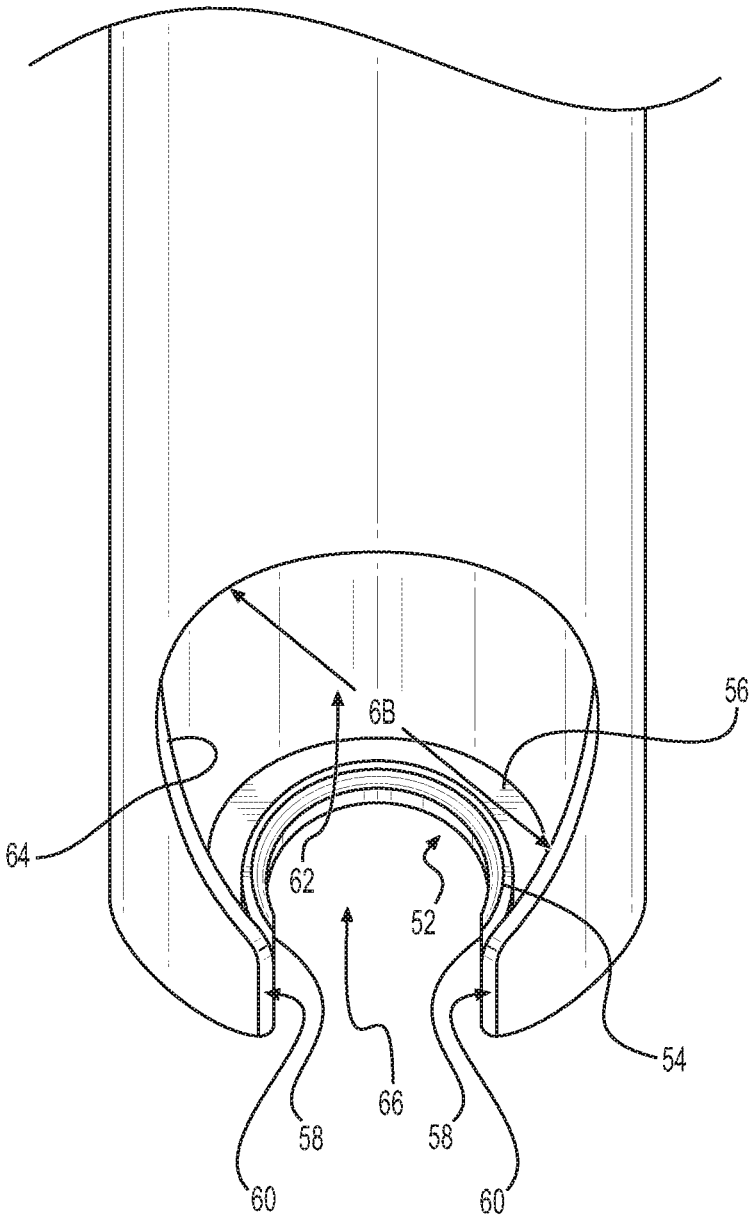
FIG. 4 is view of the lower front of the dispenser revealing internals.
Figure 5:
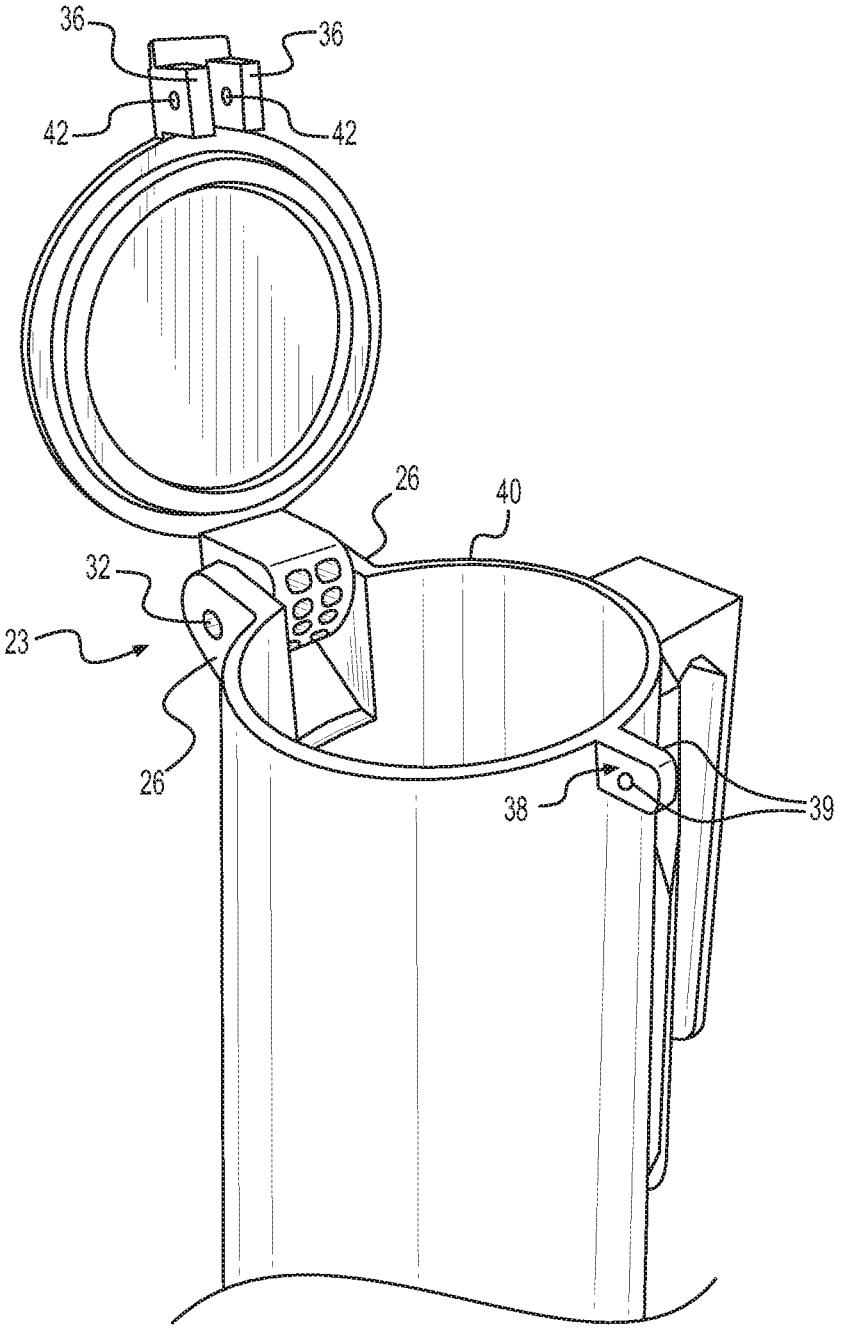
FIG. 5 is a perspective view showing the details of the lid from the front right.
Figure 6:
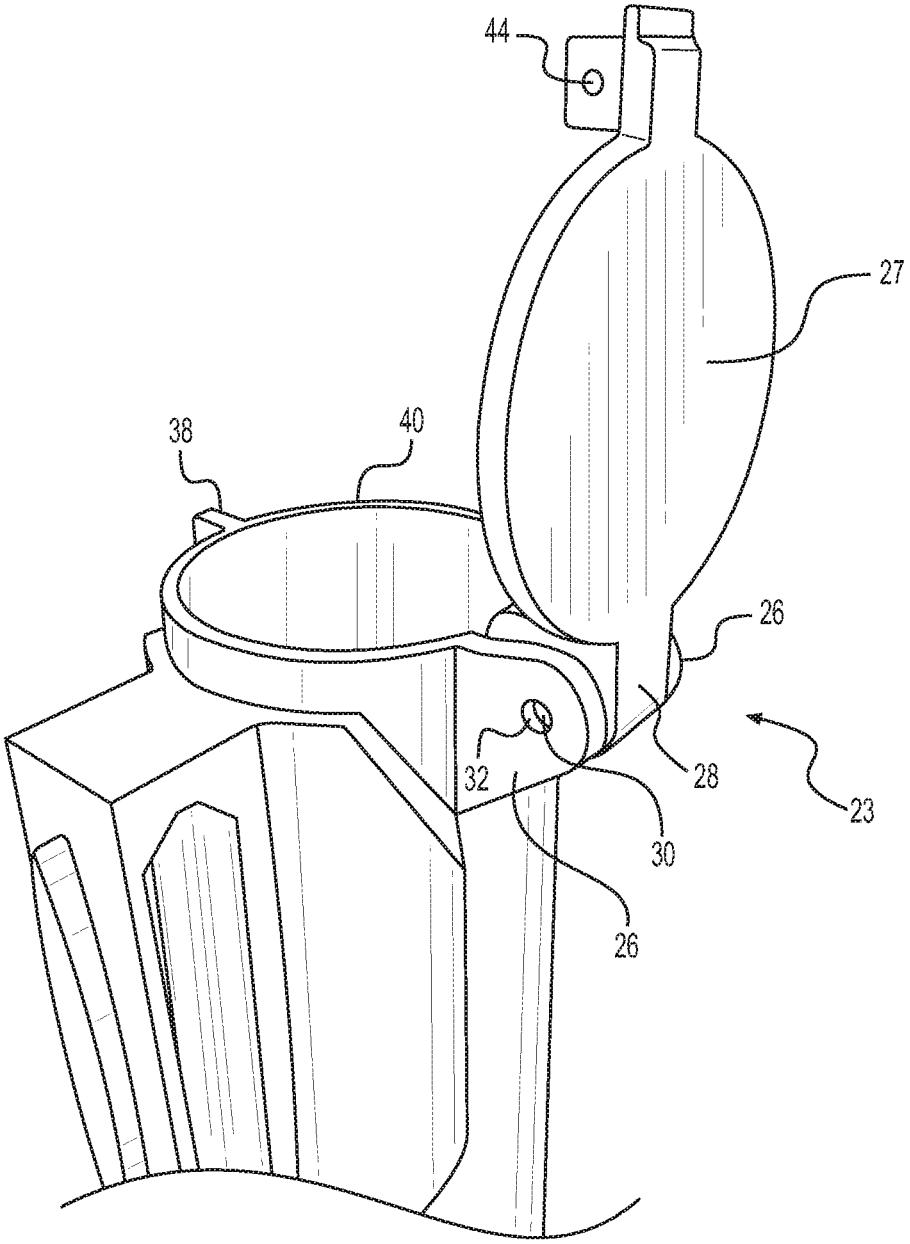
FIG. 6 is a perspective view showing the details of the lid from the back right.

A body 46 of the dispenser 10 is substantially cylindrical. Referring to FIG. 3, an outwardly extending stand 45 exists on the lower external surfaces of the body 46 and serves to maintain the dispenser in an upright state. Stand 45 extends outwards from the outer surface of the cylinder to the same extent as does a bearing surface 47 of the clip 14 internals to properly orient the dispenser when installed on a bag.

The inside surface of the dispenser 10 has a diameter 48 which is only slightly larger than the diameter of a golf ball. This allows free passage of any golf balls, for example, golf balls 50, down the dispenser 10. Thus, when a ball 50 is dropped into the mouth (which is defined by rim 40 at the top of dispenser 10), that ball will drop freely towards the bottom of the dispenser where it is caught on an inwardly and upwardly extending shelf 52 (see FIG. 4) which is formed inside of the bottom of body 46. More specifically, the ball rests atop a ridge 54 that extends up from an inwardly extending portion 56. The shelf 52 and ridge 54 are in coaxial relation inside the cylindrical body 46, but not completely in that there is a termination at opposing walls 58. This results in a crescent aperture 66 existing below the ball. Crescent shaped aperture 66 is small enough that the ball cannot pass through, and thus, the ball rests atop the ridge 54.

Ridge 54 and shelf 52 terminate to create an opening dimension 60 between two opposing wall ends 58. The wall ends—essentially a pair of coaxial opposed termination points of the shelf—create openness from below and out the front of the cylindrical body. This enables a user to lift a finger up through a crescent-shaped aperture and retrieve a ball through the retrieval opening.

The opening dimension 60 is sized to allow an average person's finger pass through, but not allow passage of a golf ball 50 so that the ball, when dropped down the cylindrical body 46, will rest atop the ridge and not come out even when balls 50 are stacked above it.

The wall of body 46, above the dimension 60, is widened and forms a retrieval opening 62 which is defined by a ball-shaped edge 64 of the cylindrical body 46. A diameter 68 of the ball-shaped edge 64 is configured to be only slightly larger than a typical golf ball. This enables a golfer to insert a finger from below the dispenser, lift up and through the crescent-shaped aperture 66, and pull the ball out and through the ball opening defined by ball shaped edge 64. When this occurs, any balls above the one removed will drop down and rest atop the ridge 54 until removed by a user.

Many different arrangements of the various components depicted, as well as components not shown, are possible without departing from the spirit and scope of what is claimed herein. Embodiments have been described with the intent to be illustrative rather than restrictive. Alternative embodiments will become apparent to those skilled in the art that do not depart from what is disclosed. A skilled artisan may develop alternative means of implementing the aforementioned improvements without departing from what is claimed.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A ball dispenser apparatus comprising:

a cylindrical body having a ball-receiving opening at a top portion, the body having an internal diameter sized to allow the passage of a golf ball;

a member extending inwardly at a bottom of the cylindrical body, the inwardly-extending member creating an internal dimension in the body, the internal dimension being sized to restrict the ball from falling out the bottom of the cylindrical body, and to rest in a position at the bottom of the cylindrical body;

wherein the member extending inwardly at a bottom of the cylindrical body is an internally extending shelf which is coaxial with the cylindrical body for a substantial portion of the circular cross section of the cylindrical body;

wherein the shelf extends coaxially inwardly from a substantial portion of the cylindrical body, and then extends upward to create a vertically-elevated ball-supporting ridge, all points of the ball-supporting ridge being in a substantially common plane, and the ball-supporting ridge comprising a complete source of vertical support for the ball within the body;

wherein the shelf and a pair of coaxial opposed termination points of the shelf are defined behind two opposing wall ends defined into the cylindrical body;

the shelf, termination points, and two opposing wall ends combining to create crescent-shaped aperture from below and a ball-shaped opening in front of the body, enabling a user to lift a finger up through the crescent-shaped aperture and lift a ball; and a retrieval opening formed into in a lower portion of the cylindrical body, the opening being sized to allow for a lifted ball to be pulled out of the body.

2. The apparatus of claim 1, further including a hinged lid for the ball-receiving opening, the lid being openable for the loading of golf balls, or latchable to contain balls within the cylindrical body.

3. The apparatus of claim 1, further including a clip on the back of the cylindrical body for installing the dispenser on a golf bag.

4. The apparatus of claim 1, wherein the cylindrical body is one of translucent and transparent.

5. The apparatus of claim 1, wherein the cylindrical body is opaque.

* * * * *